US005712437A

United States Patent [19]

Kageyama

[11] Patent Number: 5,712,437

[45] Date of Patent: Jan. 27, 1998

[54] AUDIO SIGNAL PROCESSOR SELECTIVELY DERIVING HARMONY PART FROM POLYPHONIC PARTS

[75] Inventor: Yasuo Kageyama, Hamamatsu, Japan

[73] Assignee: Yamaha Corporation, Hamamatsu, Japan

[21] Appl. No.: 599,763

[22] Filed: Feb. 12, 1996

[30] Foreign Application Priority Data

| | | | |
|---|---|---|---|
| Feb. 13, 1995 | [JP] | Japan | 7-024337 |
| Nov. 21, 1995 | [JP] | Japan | 7-303046 |
| Nov. 21, 1995 | [JP] | Japan | 7-303047 |

[51] Int. Cl.[6] ..... G10H 1/08; G10H 1/36

[52] U.S. Cl. ..... 84/610; 84/625; 84/650; 84/660

[58] Field of Search ..... 84/603, 609–614, 84/625, 634–638, 645, 649–652, 660, 666–669

[56] References Cited

U.S. PATENT DOCUMENTS

| | | | |
|---|---|---|---|
| 4,915,001 | 4/1990 | Dillard . | |
| 5,202,528 | 4/1993 | Iwaooji . | |
| 5,231,671 | 7/1993 | Gibson et al. | 84/625 X |
| 5,235,124 | 8/1993 | Okamura et al. | 84/645 X |
| 5,446,238 | 8/1995 | Koyama et al. | 84/669 |
| 5,477,003 | 12/1995 | Muraki et al. | 84/610 |
| 5,525,749 | 6/1996 | Aoki | 84/609 |
| 5,567,901 | 10/1996 | Gibson et al. | 84/603 |

FOREIGN PATENT DOCUMENTS 488732 6/1992 European Pat. Off. .

*Primary Examiner*—Stanley J. Witkowski
*Attorney, Agent, or Firm*—Loeb & Loeb LLP

[57] ABSTRACT

In an audio signal processor, an input device inputs a polyphonic audio signal containing a plurality of melodic parts which constitute a music composition. A detecting device detects a particular one of the melodic parts contained in the input polyphonic audio signal. An extracting device extracts the detected melodic part from the input polyphonic audio signal. A harmony generating device shifts a pitch of the extracted melodic part to generate a harmony audio signal representative of an additional harmony part. An output device mixes the generated harmony audio signal to the input polyphonic audio signal so as to sound the music composition which contains the additional harmony part derived from the particular one of the melodic parts.

17 Claims, 6 Drawing Sheets

AUDIO SIGNAL PROCESSOR SELECTIVELY DERIVING HARMONY PART FROM POLYPHONIC PARTS

BACKGROUND OF THE INVENTION

The present invention relates to an audio signal processor which introduces a harmony voice signal to a melody audio signal such as a singing voice signal, and more particularly relates to an audio signal processor which selectively adds a harmony voice signal to a singing voice signal having a particular melody that is detected among a plurality of concurrently input melody voice signals.

In the prior art, to cheer up karaoke singing, there is known a karaoke apparatus which creates a harmony voice, for example, third degree higher than the singing voice of a karaoke singer, and which reproduces the harmony voice together with the original singing voice. Generally, such a harmonizing function of the karaoke apparatus is achieved by shifting a pitch of the singing voice signal to generate the harmony voice signal.

Karaoke songs that can be performed by the karaoke apparatus may contain duet songs which are composed of a multiple of melodic parts and which are sung by multiple (two) singers. In performance of the duet song, two singing voices are input to the karaoke apparatus at the same time, and the conventional karaoke apparatus having the harmonizing function adds harmonies to all of the input singing voice signals. As a result the multiple parts of the reproduced song interfere with each other and tend to be inarticulate, resulting in disturbing the duet singing voice rather than cheering up the karaoke singing performance.

SUMMARY OF THE INVENTION

An object of the present invention is to provide a karaoke apparatus, which can extract a particular part from an input polyphonic audio signal containing multiple singing voices and which selectively adds a harmony audio signal to the particular part.

According to the present invention, an audio signal processor comprises an input device that inputs a polyphonic audio signal containing a plurality of melodic parts which constitute a music composition, a detecting device that detects a predetermined one of the plurality of the melodic parts contained in the input polyphonic audio signal, an extracting device that extracts the detected melodic part from the input polyphonic audio signal, a harmony generating device that shifts a pitch of the extracted melodic part to generate a harmony audio signal representative of an additional harmony part, and an output device that mixes the generated harmony audio signal and the input polyphonic audio signal so as to sound the music composition which contains the additional harmony part derived from the predetermined one of the melodic parts. In a specific form, the input device inputs a polyphonic audio signal containing a principal melodic part and a non-principal melodic part, and the detecting device specifically detects the principal melodic part, so that the additional harmony part derived from the principal melodic part is introduced into the sounded musical composition. Alternatively, the input device inputs a polyphonic audio signal containing a principal melodic part and at least one non-principal melodic part, and the detecting device detects the non-principal melodic part.

The audio signal processor according to the present invention operates as described below. First of all, the polyphonic audio signal is input through the audio signal input device. In an embodiment, the audio signal processor is implemented in a karaoke apparatus, and the audio signal input device includes pickup devices, such as, for example, microphones for karaoke singers, and an amplifier to amplify the microphone outputs. The particular part detecting device detects an audio signal component corresponding to a particular melodic part among the input multiple melodic parts. The particular part may be one of the main or principal melody part, harmony part, call-and-response part, for instance. The particular part can be detected according to memorized information indicative of a pattern of the particular part. The particular part is detected when the same coincides with the memorized information. Alternatively, a particular part conforming to a given rule can be detected. For example, the rule is such that the highest note is presumed to form a part of the main melody part to be detected The detected audio signal component corresponding to the particular part is extracted from the input polyphonic audio signal. The particular part audio signal component can be extracted by selecting one of input channels through which the particular part audio signal is input, if the polyphonic audio signal is collectively input through independent input channels such as a plurality of separate microphones. Alternatively, frequency components corresponding to fundamental frequencies of the particular part are separated from the polyphonic audio signal by filtering if the polyphonic audio signal is input through a common input channel such as a single pickup device or microphone. The pitch of the extracted particular melodic part is shifted in order to generate the harmony audio signal. The pitch can be shifted by simply changing a clock to read out the digitized and temporarily stored audio signal component of the particular melodic part. Otherwise, the harmony audio signal can be generated by shifting frequency components of the sound of the particular part without altering a formant thereof. The generated harmony audio signal is mixed with the input polyphonic audio signal to thereby reproduce the composite audio signal.

DESCRIPTION OF EMBODIMENTS

A karaoke apparatus, in accordance with an embodiment of the present invention, will be described with reference to the drawings. The karaoke apparatus is structured in the form of a sound source karaoke apparatus. The sound source karaoke apparatus includes a sound source device and generates karaoke sound by driving the sound source device according to karaoke song data. The song data is the sequence data composed of parallel tracks which record performance data sequences specifying pitch and timing of playing notes etc. The karaoke apparatus has a harmonizing function to create harmony voices having third or fifth degree of pitch difference relative to the original voice signal of the karaoke singer. The harmony voices are generated and reproduced by shifting the pitch of the voice signal of the karaoke singer. Further, even in the duet song performance where two singers sing two different parts, the apparatus can detect one of the melody parts, for example, a main or principal melody part, and creates an additional harmony part only for the detected main melody part.

Figure 1:
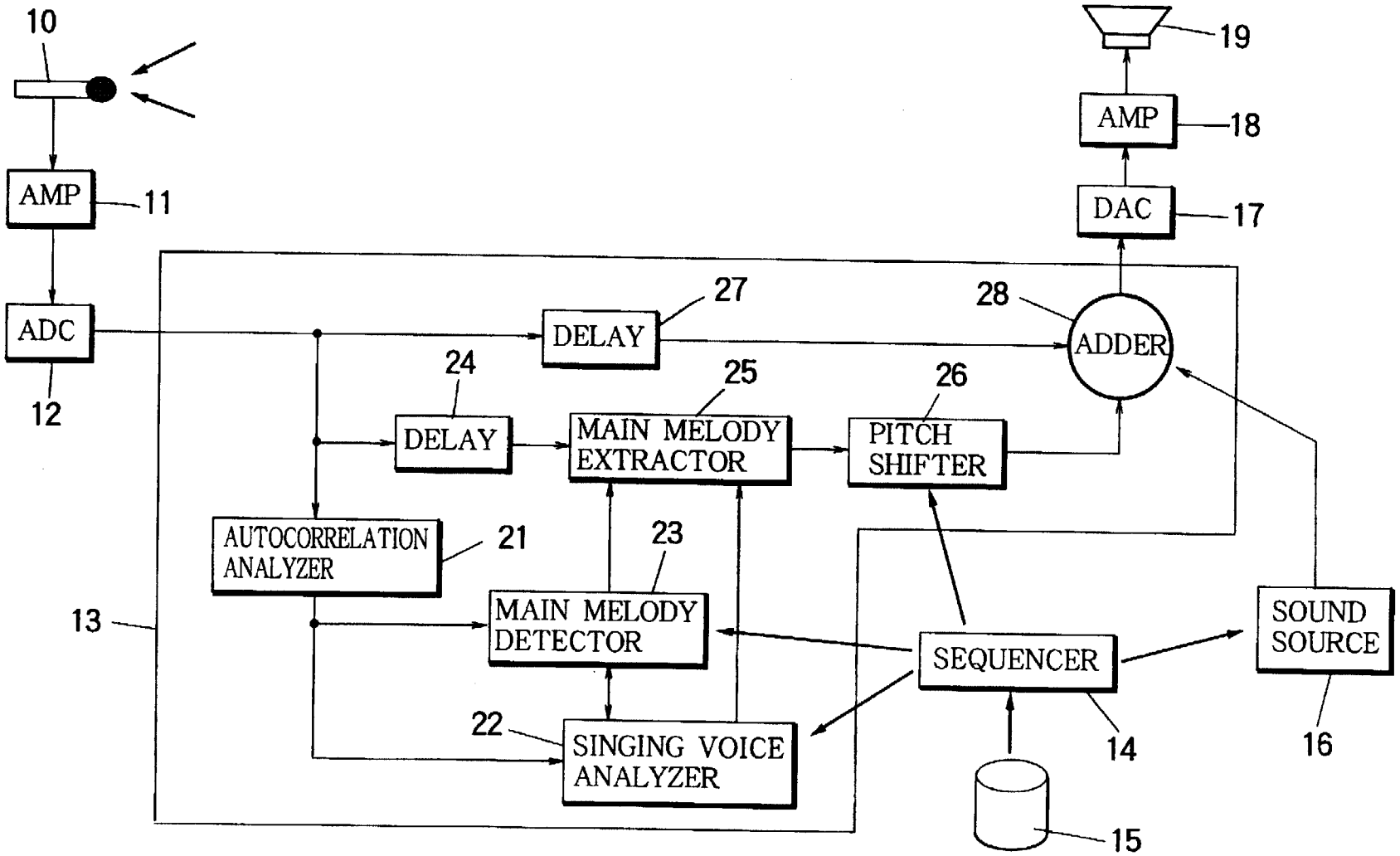
FIG. 1 is a schematic block diagram of a karaoke apparatus in accordance with an embodiment of the present invention.

FIG. 1 is a schematic block diagram of the karaoke apparatus. FIG. 1 shows an audio signal processor included in the karaoke apparatus for generating a karaoke accompaniment sound and for processing the singing voice of the karaoke singer. The karaoke apparatus includes a display controller for displaying lyric words or background image, a song request controller and other components which are not shown because they have conventional structures of the prior art. The song data used to perform a karaoke song is stored in a hard disc drive (HDD) 15. The HDD 15 stores several thousands of song data files. By choosing a desired song title by a song selector, (not shown) a sequencer 14 reads out song data of the selected song title. The sequencer 14 is provided with a memory to temporarily store the read out song data, and a sequence program processor to sequentially read out the data from the memory. The read out data is subjected to predetermined processes on a track by track basis.

Figure 2A:
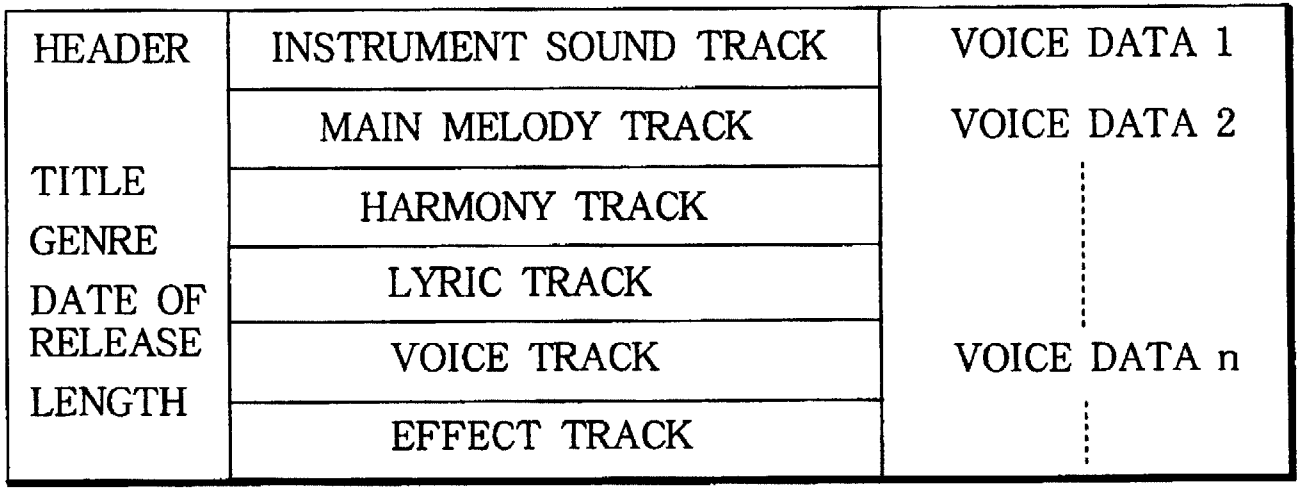
FIGS. 2A and 2B show data configurations of song data processed by the karaoke apparatus.
Figure 2B:
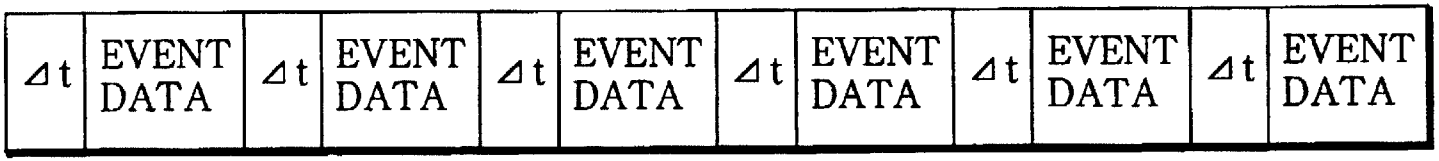

FIGS. 2A and 2B show configuration of the song data. In FIG. 2A, the song data includes a header containing the title and genre of the song, followed by an instrument sound track, a main melody track, a harmony track, a lyric track, a voice track, an effect track, and a voice data block. The main melody track is comprised of a sequence of event data and duration data $\Delta t$ specifying an interval between adjacent events as shown in FIG. 2B. The sequencer 14 counts the duration data $\Delta t$ with a predetermined tempo clock. After counting up the duration data $\Delta t$, the sequencer 14 reads out a next event data. The event data of the main melody track is distributed to a main melody detector 23 to select or detect a main melody part contained in the polyphonic audio signal input by a plurality of the karaoke players. Namely, the event data of the main melody data is utilized as particular part information to detect a particular part such as the main or principal melodic part.

As for the remaining tracks other than the main melody track, namely, the instrumental sound track, harmony track, lyric track, voice track, and effect track are composed of a sequence of event data and duration data, in a manner similar to the main melody track. The instrumental sound track comprises multiple subtracks such as instrumental melody tracks of the karaoke accompaniment, rhythm tracks, and chord tracks.

In the karaoke performance, the sequencer 14 reads out the event data from the instrumental sound track and sends the event data to a sound source 16. The sound source 16 generates musical accompaniment sound according to the event data. The lyric track is a sequence track to display lyrics on a monitor. The sequencer 14 reads out the event data from the lyric track, and sends the data to a display controller. The display controller controls the lyric display according to the event data. The voice track is a sequence track to specify generation timings of a human voice such as a backing chorus and a call-and-response chorus, which are hard to synthesize by the sound source 16. The chorus voice signal is recorded as a multiple of voice data in the voice data block. In the karaoke performance, the sequencer 14 reads out the event data from the voice data track. The voice data specified by the event data is sent to an adder 28. The effect track is a sequence track to control an effector composed of a DSP included in the sound source 16. The effector imparts sound effects such as reverberation to an input signal. The effect event data is fed to the sound source 16. The sound source 16 generates the instrumental sound signal having specified tones, pitches and volumes according to the event data of the instrumental sound track received from the sequencer 14. The generated instrumental sound signal is fed to the adder 28 in a DSP 13.

The karaoke apparatus is provided with an input device or pickup device in the form of a single or common microphone 10. When a pair of singers sing in duet song performance, the two singing voices are picked up by the single microphone 10. A polyphonic audio signal of the singing voices picked up by the microphone 10 is amplified by an amplifier 11, and is then converted into a digital signal by an ADC 12. The digitally converted audio signal is fed to the DSP 13. The DSP 13 stores microprograms to carry out various functions schematically shown as blocks in FIG. 1, and executes the microprograms to carry out all the functions shown as the blocks within each sampling cycle of the digital audio signal.

In FIG. 1, the digital signal input via the ADC 12 is fed to an autocorrelation analyzer 21 and delays 24 and 27. The autocorrelation analyzer 21 analyzes a cycle of a maximal value or peak of the input polyphonic audio signal, and detects a fundamental frequency of the singing voices of the multiple karaoke singers.

Figure 7A:
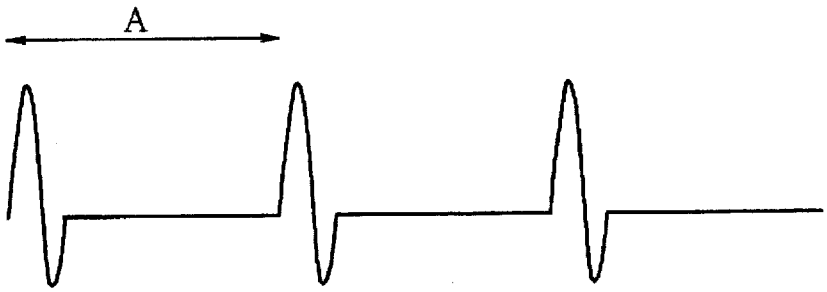
FIGS. 7A, 7B and 7C show waveforms of wave components of a polyphonic audio signal.
Figure 7B:
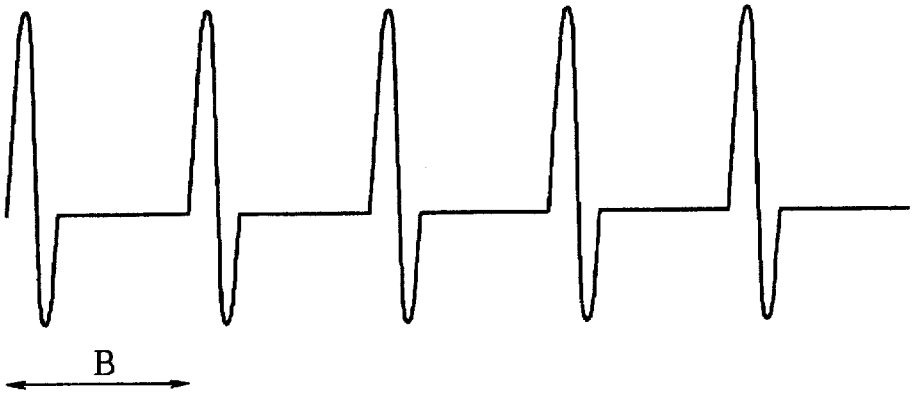
Figure 7C:
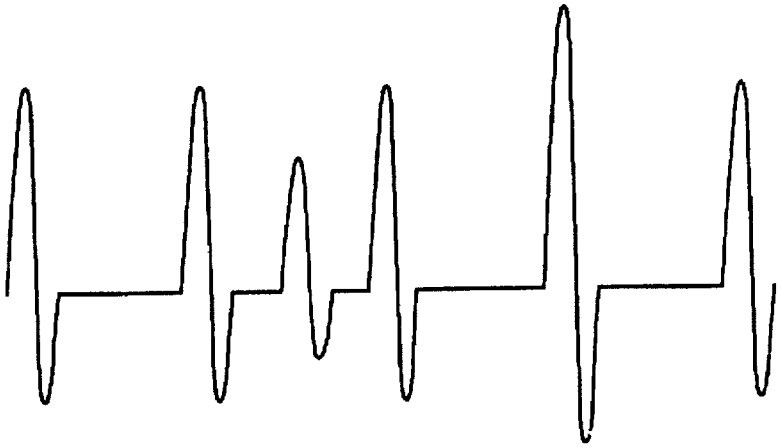

A basic principle of the detection of the fundamental frequency is schematically illustrated in FIGS. 7A–7C. FIG. 7C shows a waveform of the input polyphonic audio signal, while FIGS. 7A and 7B show waveforms of two frequency components contained in the input polyphonic audio signal. The first component shown in FIG. 7A has a longer period A, while the second component shown in FIG. 7B has a shorter period B. For example, the period B is two-thirds of the period A. Every peak or maximal value of the input polyphonic audio signal is detected so that the shorter period B of the second frequency component is determined as a time interval between first and second peaks of the input polyphonic audio signal. A third peak of the input polyphonic audio signal of FIG. 7C falls inbetween the period B. Thus, the third peak is discriminated from the peaks of the second frequency component, and is determined to belong to the first frequency component. Consequently, the longer period A of the first frequency component is determined as a time interval between the first and third peaks. The fundamental frequency is given by reciprocal of the detected period.

Figure 3:
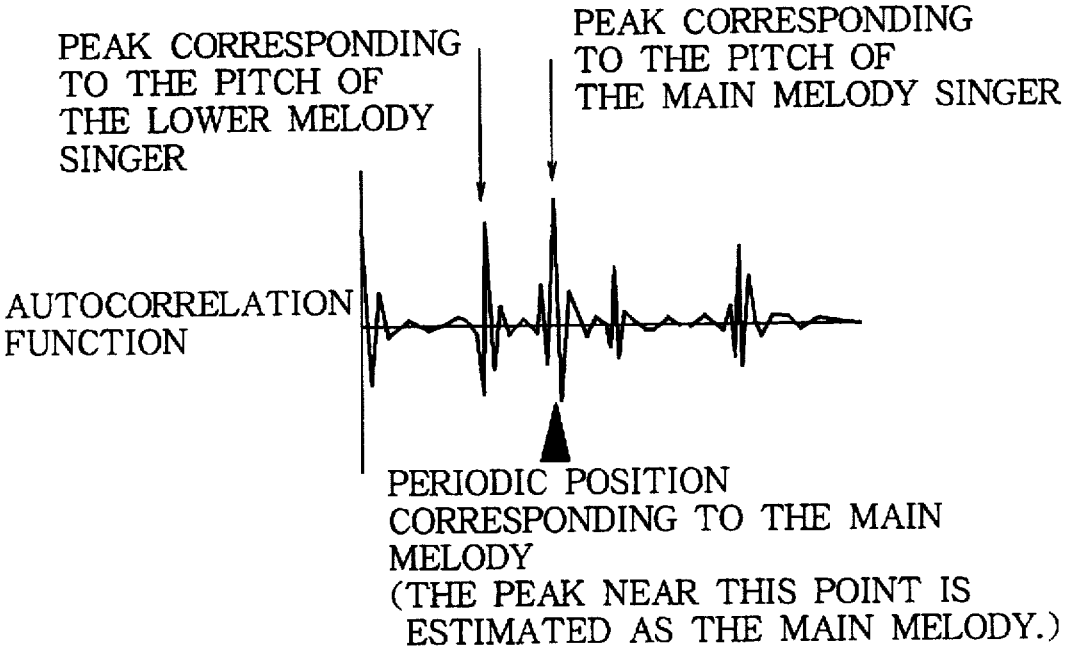
FIG. 3 shows autocorrelation analysis of an input polyphonic audio signal.

FIG. 3 shows a method of the autocorrelation analysis carried out by the autocorrelation analyzer 21. The theory of the autocorrelation analysis is known in the art, and therefore its computation details are omitted. Since the autocorrelation function of a periodic signal (i.e., the input polyphonic audio signal) is also a periodic signal having the same period as the original, the autocorrelation function of the signal having a sampling period P reaches a maximal value at 0, ±P, ±2P . . . samples regardless of the time origin of the signal. This period P corresponds to the periods A and B shown in FIGS. 7A and 7B. Thus, the period of the signal can be estimated by searching the first maximal value of the autocorrelation function. In FIG. 3, the maximal values appear at plural points, each of which is not at the whole or integer number ratio, hence it can be seen that these values correspond respectively to different periods of the singing voices of the two singers having the different frequency distributions. Thus, the fundamental frequencies of the singing voices can be detected separately for the pair of the karaoke players. The autocorrelation analyzer 21 sends the detected fundamental frequency information to those of a singing voice analyzer 22 and a main melody detector 23. As a voiced sound contained in the singing voice has a periodic waveform while a breathed sound has a noise-like waveform, the voiced and breathed sounds can be discriminated from each other by the autocorrelation analyzer 21. The result of the voiced/breathed sound detection is fed to the singing voice analyzer 22.

The main melody detector 23 detects which of the fundamental frequencies contained in the polyphonic audio signal input from the autocorrelation analyzer 21 corresponds to the singing voice of the main melody part according to the main melody information (the event data of the main melody track) input from the sequencer 14. The detection result is provided to a main melody extractor 25.

The singing voice analyzer 22 analyzes a state of the singing performance according to the analysis information including the fundamental frequency data input from the autocorrelation analyzer 21. The state of the singing performance represents whether the number of the active singer is 0 (no voice period such as interlude), 1 (solo verse or call-and-response period), or 2 or more (duet singing period).

The singing voice analyzer 22 detects the state of the singing performance, and further detects whether the singing voice of a non-principal melodic part other than the principal melodic part harmonizes with the principal melodic part if multiple singers are concurrently singing. Such a detection is conducted based on the harmony information (the event data of the harmony track) input from the sequencer 14. The singing voice analyzer 22 detects also whether the singing voice of the principal or main melody part is currently in a voiced vowel period or breathed consonant period.

The singing voice analyzer 22 controls the operation of the main melody detector 23 and the main melody extractor 25 according to the result of analysis. If the detected state of the singing performance indicates a no voice period, the main melody detector 23 and the main melody extractor 25 are disabled in the no voice period, because the main melody part detection and the main melody part extraction are not required. If one of the two singers sings the main melody part while the other sings its harmony part, the main melody extractor 25 is disabled, because no harmony voice should be generated to avoid overlapping with the live harmony part. Disabling of the main melody extractor 25 makes a pitch shifter 26 to stop its harmony sound generation.

Alternatively, if one of the two singers sings the main melody part while the other sings its harmony part, it is possible to shift the pitch of the main melody part to a certain degree higher or lower from the harmony part performed by the other singer. For instance, if the other singer sings third degrees higher than the main melody part, the pitch shifter 26 may shift the pitch of the main melody part fifth degrees up to thereby create another harmony part different from the live harmony part performed by the other singer.

Further, if it is detected that only one of the two singers is singing, the main melody detector 23 is disabled, because the sung part is definitely the main melody part. The main melody extractor 25 is commanded to skip or pass the input singing voice audio signal as it is. Thus, the solo singer's voice is sent to the pitch shifter 26 directly from the delay 24.

The algorithm of the main melody extractor 25 is changed depending on whether the main melody voice falls in a voiced or breathed sound period. If the voice signal of the main melody is of a voiced vowel sound, the voice signal has a relatively simple composition of harmonics of the fundamental tone (frequency), so that the extraction of the main melody part is carried out by filtering the harmonics of the composition. On the other hand, if the voice signal of the main melody is of a breathed consonant sound, the main melody part is extracted by a method different from that applied to the extraction of the breathed sound signal, because the voiced sound contains a lot of non-linear noise components.

Figure 4:
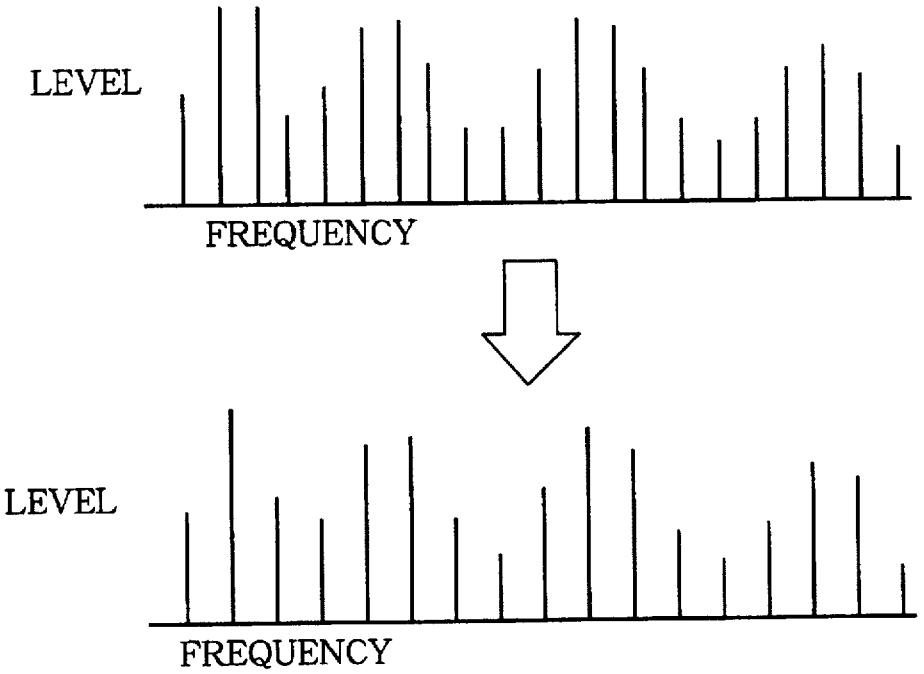
FIG. 4 shows a method of pitch shifting of the audio signal.

The voice signal of the main melody extracted by the main melody extractor 25, or the solo singer's voice signal skipped through the main melody extractor 25 is fed to the pitch shifter 26. The pitch shifter 26 shifts the pitch of the input signal according to the harmony information provided from the sequencer 14, and the resulted signal is fed to the adder 28. The pitch shifter 26 reserves a formant (an envelope of the frequency spectrum) of the signal input from the preceding stage, and shifts only the frequency components covered by the formant. The level of each pitch-shifted component is adjusted so that it coincides with the envelope of the frequency spectrum as shown in FIG. 4. Thus, only the pitch (frequency) is shifted without changing the tone of the voice.

In FIG. 1, the adder 28 receives the thus generated harmony voice signal, as well as the karaoke accompaniment signal, the chorus signal directly input from the sequencer 14, and the singing voice signal directly input through the ADC 12 and the delay 27. The adder 28 mixes these singing voice signal, harmony voice signal, karaoke accompaniment signal, and chorus sound signal to synthesize a stereo audio signal. The mixed audio signal is distributed by the DSP 13 to a DAC 17. The DAC 17 converts the input digital stereo signal into an analog signal, and send it to an amplifier 18. The amplifier 18 amplifies the input analog signal and the amplified signal is reproduced through a loudspeaker 19. The two delays 24 and 27 are suitably inserted among the blocks in DSP 13 in order to compensate a signal delay created in the autocorrelation analyzer 21, the main melody detector 23 and so on. Thus, the karaoke apparatus analyzes the polyphonic audio signal of the singing voice input through the single microphone 10, detects which of the multi-part (two part) singing voices corresponds to the main melody part, and creates a harmony part selectively for the singing voice corresponding to the main melody part, so that only the main melody is added with the harmony even in a duet karaoke song performance.

Figure 5:
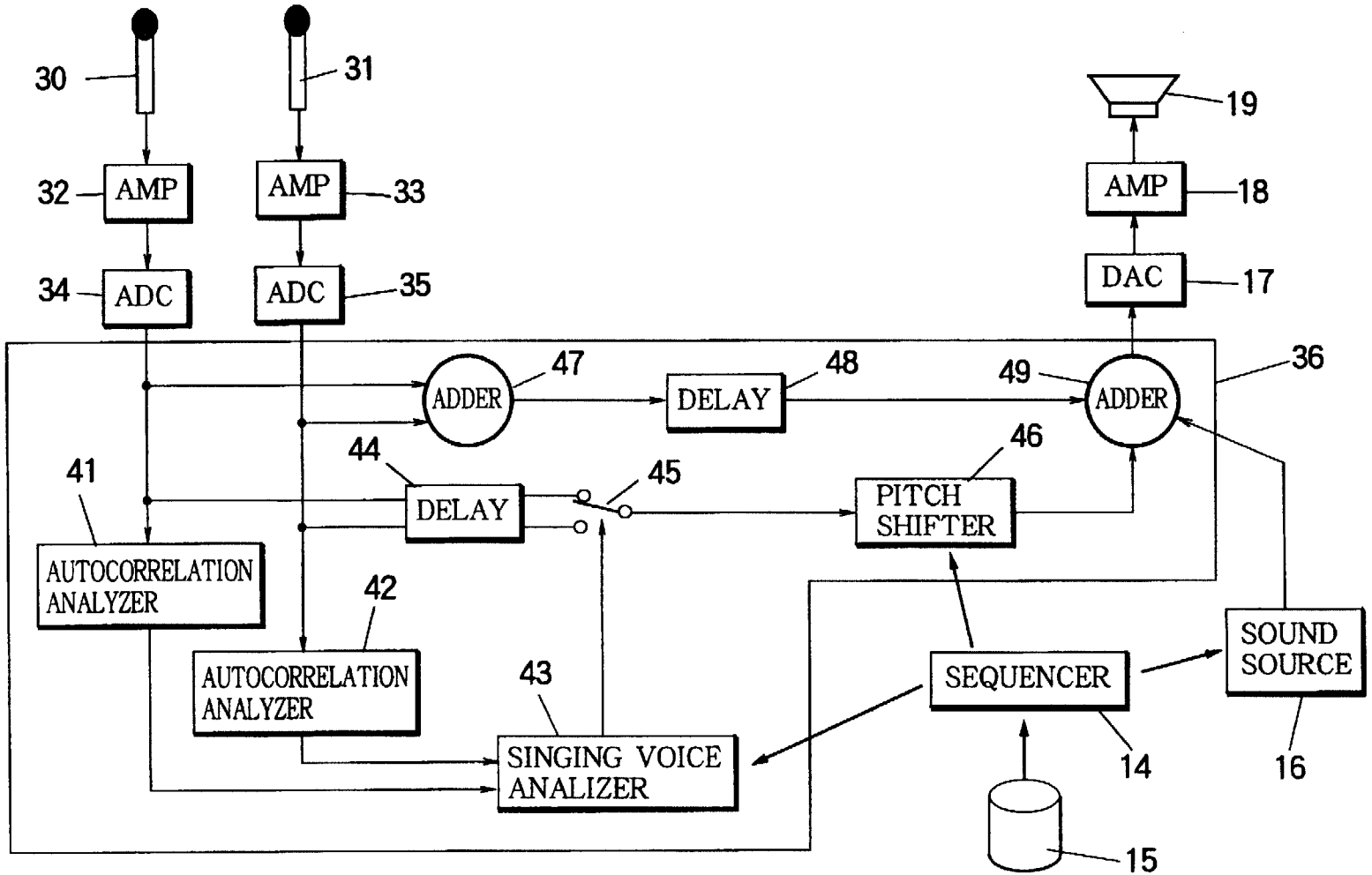
FIG. 5 is a schematic block diagram of a karaoke apparatus in accordance with another embodiment of the present invention.

FIG. 5 is a schematic block diagram of the karaoke apparatus in accordance with another embodiment of the present invention. The difference between the karaoke apparatus shown in FIG. 1 (the first embodiment) and the embodiment shown in FIG. 5 is that the apparatus shown in FIG. 5 is provided with a multiple (two in FIG. 5) of microphones for each of the karaoke singers. Each singing voice signal of the singer is separately or independently fed to a DSP 36. In FIG. 5, the same reference numerals are attached to the blocks of the memory for the karaoke song data, the readout device for reading out the karaoke song data, and the signal processing system of the audio signal after the singing voice signal and the karaoke accompaniment signal are mixed with each other. The explanation for the memory, the readout device and the signal processing system will be abridged hereunder, because they are the same as those in the first embodiment.

The outputs from the two microphones 30, 31 for duet singing are respectively amplified by amplifiers 32 and 33, and are then converted into digital signals by ADCs 34 and 35 before they are input to a DSP 36. In a DSP 36, a first singing voice signal input via the microphones 30 is fed to an autocorrelation analyzer 41 and to a delay 44 and an adder 47. A second singing voice signal input via the microphone 31 is fed to an autocorrelation analyzer 42 and to the delay 44 and the adder 47. The autocorrelation analyzers 41 and 42 respectively analyze the fundamental frequencies of the first and second singing voice signals. In this arrangement, the autocorrelation analyzers 41 and 42 need not separate the pair of the singing voices from each other to analyze the fundamental frequency. The result of the analysis is sent to a singing voice analyzer 43. The singing voice analyzer 43 checks or detects as to the number of singers, the main melody, and the harmony according to the input fundamental frequencies of the two singing voice signals, and the information relating to the main melody and the harmony melody input from the sequencer 14. Namely, the singing voice analyzer 43 detects if two singers are singing in duet, which singer is singing the main melody part in case of the duet singing, and if one voice signal harmonizes with the other. If the main melody part is detected, a corresponding select signal is fed to a selector 45. The selector 45 switches the signal path so that the singing voice signal detected as the main melody part is distributed to a pitch shifter 46. The pitch shifter 46 shifts the pitch of the input audio signal according to the harmony information input from the sequencer 14 for harmony voice generation. The harmony information is designed to determine a pitch shift amount of the main melody to create the corresponding harmony melody.

The harmony voice signal is fed to an adder 49. The adder 49 receives the harmony voice signal, as well as the karaoke accompaniment signal from the sound source 16, the chorus signal directly input from the sequencer 14, and the singing voice signal directly input through the ADCs 34 and 35, the adder 47 and a delay 48. The adder 49 mixes these singing voice signal, harmony voice signal, karaoke accompaniment signal, and chorus signal to create a stereo audio signal. The mixed audio signal is distributed by the DSP 36 to a DAC 17. In the embodiment described above, only the singing voice signal corresponding to the main melody part in a duet song is harmonized. However, it is possible to create a harmony selectively to a non-principal melody part other than the principal or main melody part, for example a call-and-response part. Further, it is possible to create harmonies to both of the principal melody part and the non-principal melody part. For instance, in the apparatus shown in FIG. 5, a preferred or desired part may be selected and extracted for the harmony generation, with arranging the selector 45 switchable to the preferred part (the main melody part or the other part), and with distributing harmony information of the main melody part or the other part to the pitch shifter 46 in matching with the state of the selector 45.

Figure 6:
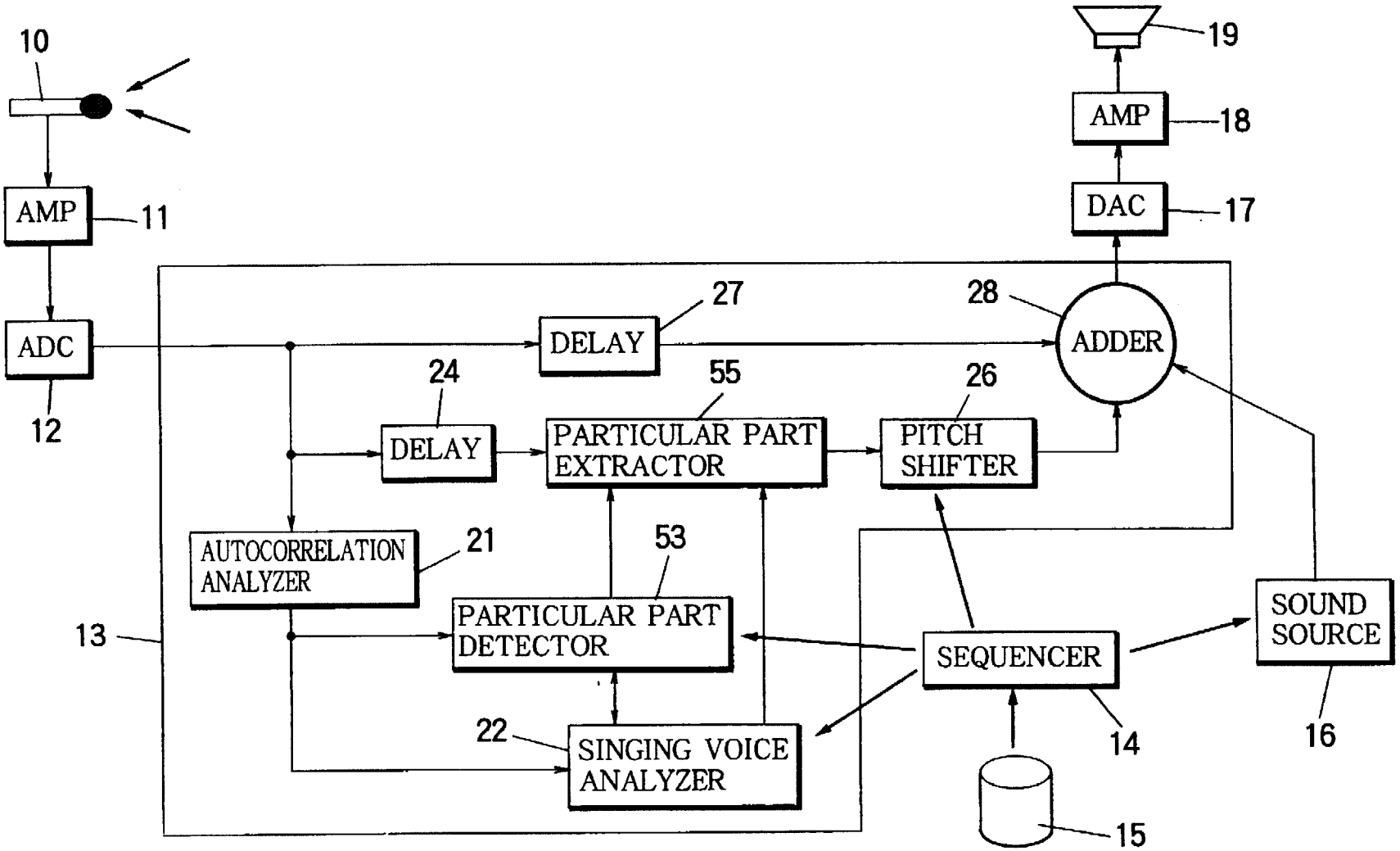
FIG. 6 is a schematic block diagram of a karaoke apparatus in accordance with a further embodiment of the present invention.

FIG. 6 shows an embodiment in which multiple singing voice signals are input to a single pickup device. In FIG. 6, the same reference numerals are attached to the same elements as those in FIG. 1, and the explanation thereof will be abridged hereunder. In this embodiment, the song data stored in the sequencer 14 contains a particular part track instead of the main melody track. A particular part detector 53 receives event data of the particular part track from the sequencer 14, and detects which of fundamental frequencies contained in the polyphonic audio signal from the autocorrelation analyzer 21 corresponds to the particular part. The result of the detection is entered to a particular part extractor 55. The particular part extractor 55 extracts the frequency component corresponding to the particular part from the polyphonic audio signal. The extracted component of the particular part is sent to the pitch shifter 26. The pitch shifter 26 shifts the pitch of the input signal to enrich the sound of the particular part.

As described above, according to the present invention, even if multiple parts of audio signals are input, a particular part audio signal such as the main melody part can be detected and extracted from the input signals, in order to selectively create a harmony audio signal for the extracted audio signal, so that even in the polyphonic audio signal input, only the harmony voice derived from the particular part can be introduced and the karaoke performance can be cheered up much. Further, since the main melody is detected out of the polyphonic audio signal, the main melody can be extracted out of the singing voices even if a multiple of singers exchange their parts each other.

What is claimed is:

1. An audio signal processor comprising:

an input device that inputs a polyphonic audio signal containing a plurality of melodic parts which constitute a music composition;

a detecting device that selects a predetermined one of the plurality of the melodic parts contained in the input polyphonic audio signal;

an extracting device that extracts the selected melodic part from the input polyphonic audio signal;

a harmony generating device that shifts a pitch of the extracted melodic part to generate a harmony audio signal representative of an additional harmony part; and an output device that mixes the generated harmony audio signal to the input polyphonic audio signal so as to sound the music composition which contains the additional harmony part derived from the predetermined one of the melodic parts.

2. An audio signal processor according to claim 1, wherein the input device inputs a polyphonic audio signal containing a principal melodic part and a non-principal melodic part, and wherein the detecting device specifically detects the principal melodic part, so that the additional harmony part derived from the principal melodic part is introduced into the sounded musical composition.

3. An audio signal processor according to claim 2, further comprising a harmony check device that detects when the non-principal melodic part coincides with a pattern of the additional harmony part derived from the principal melodic part, and a disabling device that disables the harmony generating device in response to the harmony detecting device to thereby inhibit generation of the additional harmony part which would overlap with the non-principal melodic part.

4. An audio signal processor according to claim 1, wherein the input device inputs a polyphonic audio signal containing a principal melodic part and at least one non-principal melodic part, and wherein the detecting device detects the non-principal melodic part.

5. An audio signal processor according to claim 1, wherein the input device comprises a single pickup device that concurrently picks up multiple sounds of the plurality of the melodic parts performed in parallel to each other to thereby input the polyphonic audio signal containing the plurality of the melodic parts.

6. An audio signal processor according to claim 5, wherein the extracting device filters the polyphonic audio signal input by the single pickup device to separate therefrom a frequency component corresponding to the detected melodic part.

7. An audio signal processor according to claim 1, wherein the detecting device comprises an analyzing device that analyzes the input polyphonic audio signal to detect therefrom a plurality of fundamental frequencies corresponding to the plurality of the melodic parts, and a selecting device that compares the plurality of the fundamental frequencies with provisionally memorized particular part information so as to select the particular one of the melodic parts which coincides with the particular part information.

8. An audio signal processor according to claim 1, wherein the harmony generating device shifts a pitch of the extracted melodic part to create the additional harmony part according to provisionally memorized harmony information which designates a pitch difference between the particular melodic part and the additional harmony part.

9. An audio signal processor according to claim 8, further comprising a harmony detecting device that detects when one of the melodic parts other than the particular melodic part coincides with the harmony information, and a disabling device that disables the harmony generating device in response to the harmony detecting device to thereby inhibit creation of the additional harmony part which would overlap with said one of the melodic parts.

10. An audio signal processor according to claim 1, further comprising a reference data source containing reference data, wherein the detecting device selects a predetermined one of the plurality of the melodic parts contained in the input polyphonic audio signal based on the reference data.

11. A harmony creating method comprising the steps of:

inputting a polyphonic audio signal containing a plurality of melodic parts which constitute a music composition;

selecting a predetermined one of the plurality of the melodic parts contained in the input polyphonic audio signal;

extracting the selected melodic part from the input polyphonic audio signal;

shifting a pitch of the extracted melodic part to generate a harmony audio signal representative of an additional harmony part; and mixing the generated harmony audio signal to the input polyphonic audio signal so as to sound the music composition which contains the additional harmony part derived from the predetermined one of the melodic parts.

12. A harmony creating method according to claim 11, wherein the predetermined one of the plurality of the melodic parts is selected based on reference data.

13. An audio signal processor comprising:

a plurality of input devices that input a plurality of audio signals representative of a plurality of melodic parts which constitute a music composition;

a selecting device that selects a specified melodic part from the plurality of the melodic parts and generates a selection signal corresponding to the specified melodic part;

a switching device coupled to the plurality of input devices that selects in response to the selection signal one of the audio signals representative of the selected melodic part;

a harmony generating device that shifts a pitch of the selected melodic part to generate a harmony audio signal representative of an additional harmony part; and an output device that mixes the harmony audio signal and the plurality of audio signals to sound the music composition which contains the additional harmony part derived from the selected one of the melodic parts.

14. An audio signal processor according to claim 13, further comprising a reference audio signal source containing a reference audio signal, wherein the selecting device selects a specified melodic part from the plurality of the melodic parts based on the reference audio signal and generates the selection signal corresponding to the specified melodic part.

15. An audio signal processor according to claim 13, wherein the selecting device automatically selects a specified melodic part.

16. An audio signal processor according to claim 13, wherein the plurality of input devices are two input devices that input two audio signals representative of at least a main melodic part and a non-main melodic part which constitute a music composition, the selecting device detects the main melodic part and generates the selection signal corresponding to the main melodic part, the switching device selects, in response to the selection signal, one of the two audio signals representative of the main melodic part, the harmony generating device shifts a pitch of the main melodic part to generate a harmony audio signal representative of an additional harmony part, and the output device mixes the harmony audio signal with the two audio signals to sound the music composition which contains the additional harmony part derived from the main melodic part.

17. An audio signal processor according to claim 16, further comprising a reference audio signal source containing a reference audio signal, wherein the selecting device selects the main melodic part from the two melodic parts based on the reference audio signal and generates a selection signal corresponding to the main melodic part.

* * * * *